US005884645A

United States Patent [19]

Chen et al.

[11] Patent Number: 5,884,645

[45] Date of Patent: Mar. 23, 1999

[54] COLLAPSIBLE SUNSHADE

[76] Inventors: Wu-Hsiung Chen; Chien-Jung Chen, both of No. 1, Nen-Chiang St., San-Min Dist., Kaohsiung City, Taiwan

[21] Appl. No.: 36,015

[22] Filed: Mar. 3, 1998

[51] Int. Cl.[6] ..... A45B 19/00

[52] U.S. Cl. ..... 135/25.1; 135/25.33; 135/28; 135/31

[58] Field of Search ..... 135/29, 31, 25.33, 135/26, 25.4, 28, 27, 20.3, 25.1

[56] References Cited

U.S. PATENT DOCUMENTS

| | | |
|---|---|---|
| 884,712 | 4/1908 | Casale . |
| 1,036,142 | 8/1912 | Parker . |
| 1,065,729 | 6/1913 | Salof . |
| 1,088,743 | 3/1914 | Swinland . |
| 1,217,515 | 2/1917 | Simon . |
| 1,344,132 | 6/1920 | Hughes et al. . |
| 1,707,910 | 4/1929 | Haupt . |
| 3,213,868 | 10/1965 | Forbes . |
| 5,224,505 | 7/1993 | Wu . |
| 5,740,824 | 4/1998 | Tang . |

*Primary Examiner*—Lanna Mai
*Attorney, Agent, or Firm*—Renner, Otto, Boisselle & Sklar, P.L.L.

[57] ABSTRACT

A collapsible sunshade includes a frame and a top cover which is mounted on the frame. The frame includes a shaft which has an outer tube and an inner tube that is telescopically inserted into the outer tube. A runner assembly is sleeved on the outer tube. A main rib assembly is pivoted to a top end of the inner tube for mounting the top cover. A collapsible stretcher assembly is pivoted to the main rib assembly and is connected to the runner assembly. The runner assembly can cooperate with a bottom end of the inner tube so as to move the inner tube upward and outward from the outer tube simultaneously with the stretching of the main rib assembly. Preferably, the main rib assembly is collapsible, and has pivot connectors that impede the collapsing of the main rib assembly.

10 Claims, 11 Drawing Sheets

COLLAPSIBLE SUNSHADE

BACKGROUND OF THE INVENTION

1. Field of the Invention

This invention relates to a sunshade, more particularly to a collapsible sunshade including a rib assembly and a telescopic shaft which is extended when the rib assembly is stretched.

2. Description of the Related Art

Referring to FIG. 1, a conventional sunshade 1 is shown to include a frame 11, a top cover 12 mounted on the frame 11, and a support leg 13. The frame 11 has a shaft 111 with a pivot unit 112 for pivoting a plurality of main ribs 113, a plurality of stretchers 114 with distal ends pivoted respectively to the main ribs 113, and a runner 115 which is sleeved slidably on the shaft 111. The stretchers 114 have proximal ends pivoted to the runner 115 for stretching thereof upon upward movement of the runner 115. The support leg 13 has a sleeve 131 which is provided on a bottom end of the shaft 111, and a plurality of feet 132 which are stretchably pivoted to the sleeve 131 for supporting the sunshade 1. In use, the user grasps the shaft 111 with one hand, and forces the runner 115 upward so as to stretch the stretchers 114 and the main ribs 113. The sunshade 1 can be supported on the ground by the support leg 13.

Since the stretchers 114 are not collapsible, and since the shaft 11 is not telescopic, the following drawbacks arise:

1. The user has to force the runner 115 upward to a substantial height in order to stretch the sunshade.
2. It is not suitable to make the main ribs 113 of the sunshade foldable, thereby resulting in a limited shading area of the sunshade.
3. The sunshade is inconvenient to carry and store;
4. The sunshade has limited applications.

SUMMARY OF THE INVENTION

The object of the present invention is to provide a collapsible sunshade which has a telescopic shaft and a plurality of collapsible stretchers, thereby facilitating storage and transport of the sunshade.

According to this invention, a collapsible sunshade includes a frame and a top cover which is mounted on the frame. The frame includes a shaft which has an outer tube and an inner tube that is telescopically inserted into the outer tube. A runner assembly is sleeved on the outer tube. A main rib assembly is pivoted to a top end of the inner tube for mounting the top cover. A collapsible stretcher assembly is pivoted to the main rib assembly and is connected to the runner assembly. The runner assembly can cooperate with a bottom end of the inner tube so as to move the inner tube upward and outward from the outer tube when the runner assembly is moved upward to stretch the main rib assembly.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
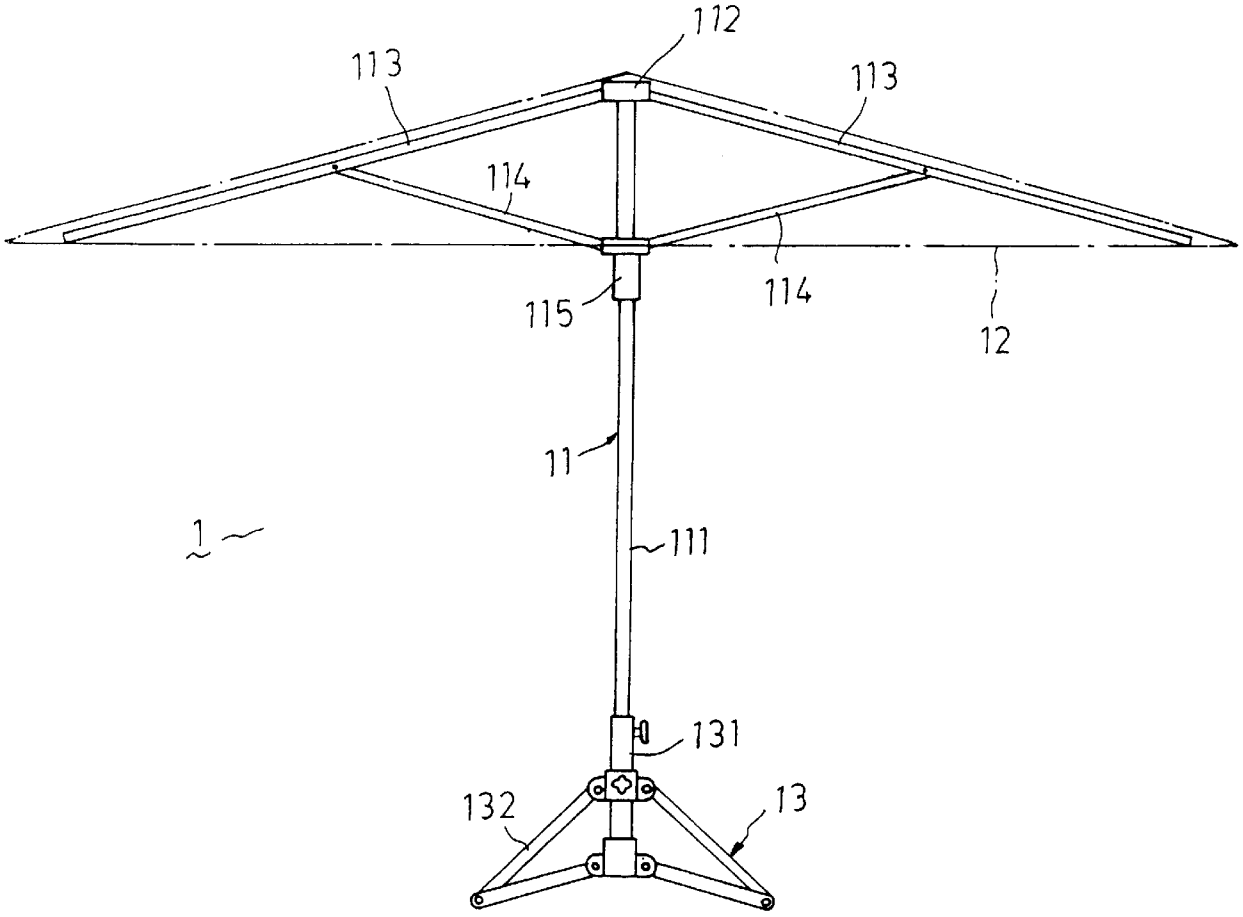
FIG. 1 PRIOR ART
FIG. 1 is a schematic view of a conventional sunshade in a stretched state.
Figure 2:
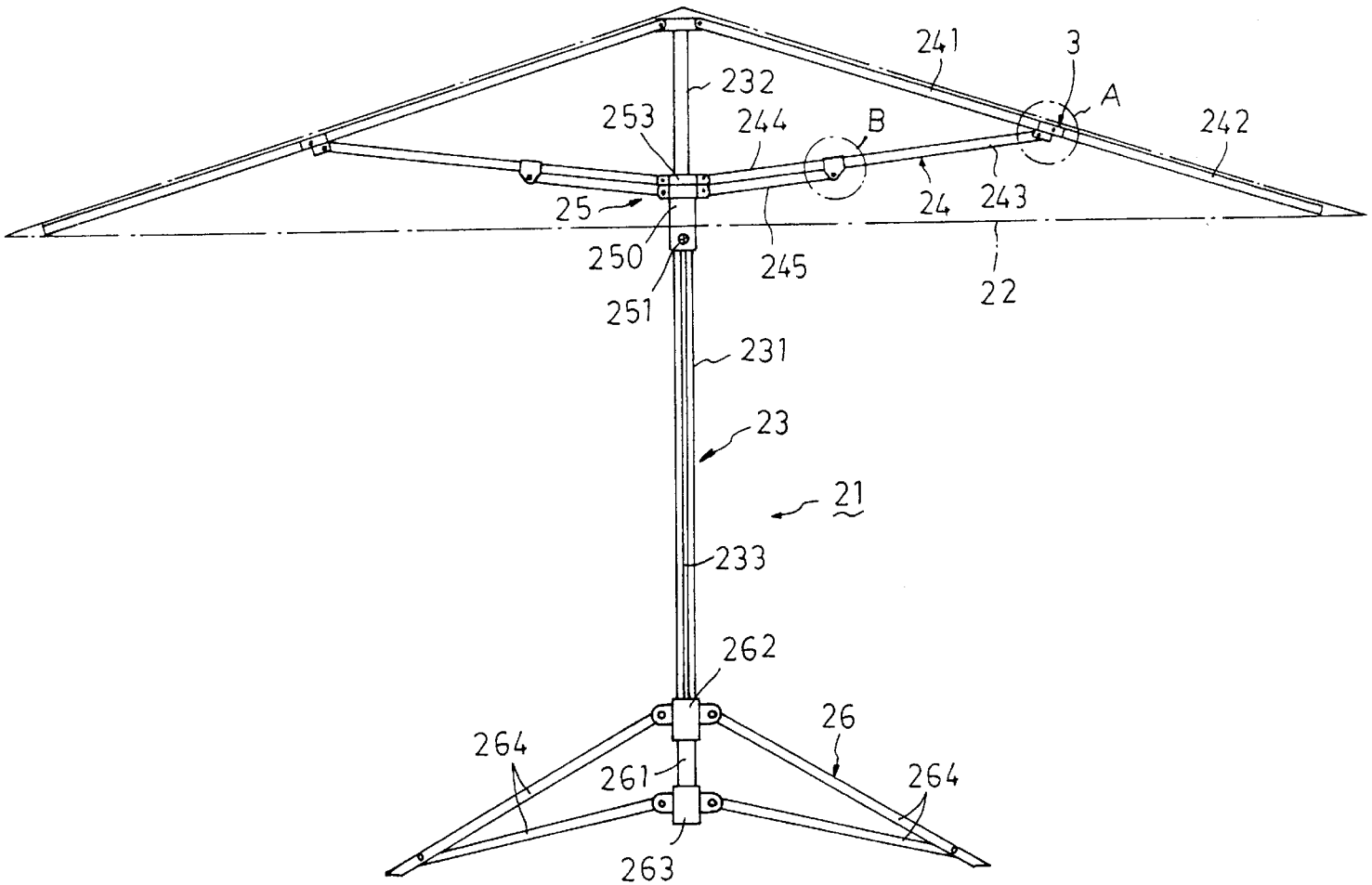
FIG. 2 is a schematic view of a preferred embodiment of a sunshade according to this invention in a stretched state.

Referring to FIG. 2, a preferred embodiment of a sunshade according to the present invention is shown to comprise a frame 21 and a top cover 22 which is mounted on the frame 21. The frame 21 includes a shaft 23, a runner assembly 25 which is sleeved on the shaft 23, a main rib assembly, and a stretcher assembly. In addition, a support leg 26 is mounted to a bottom end of the shaft 23 when the sunshade is opened. The support leg 26 has a tube 261 sleeved on the shaft 23, upper and lower sleeves 262, 263 which are slidably mounted at two ends of the tube 261, and a plurality of legs 264 which are pivoted to the upper and lower sleeves 262, 263 so as to be extended or collapsed by moving the upper sleeve 262 along the shaft 23.

Figure 3:
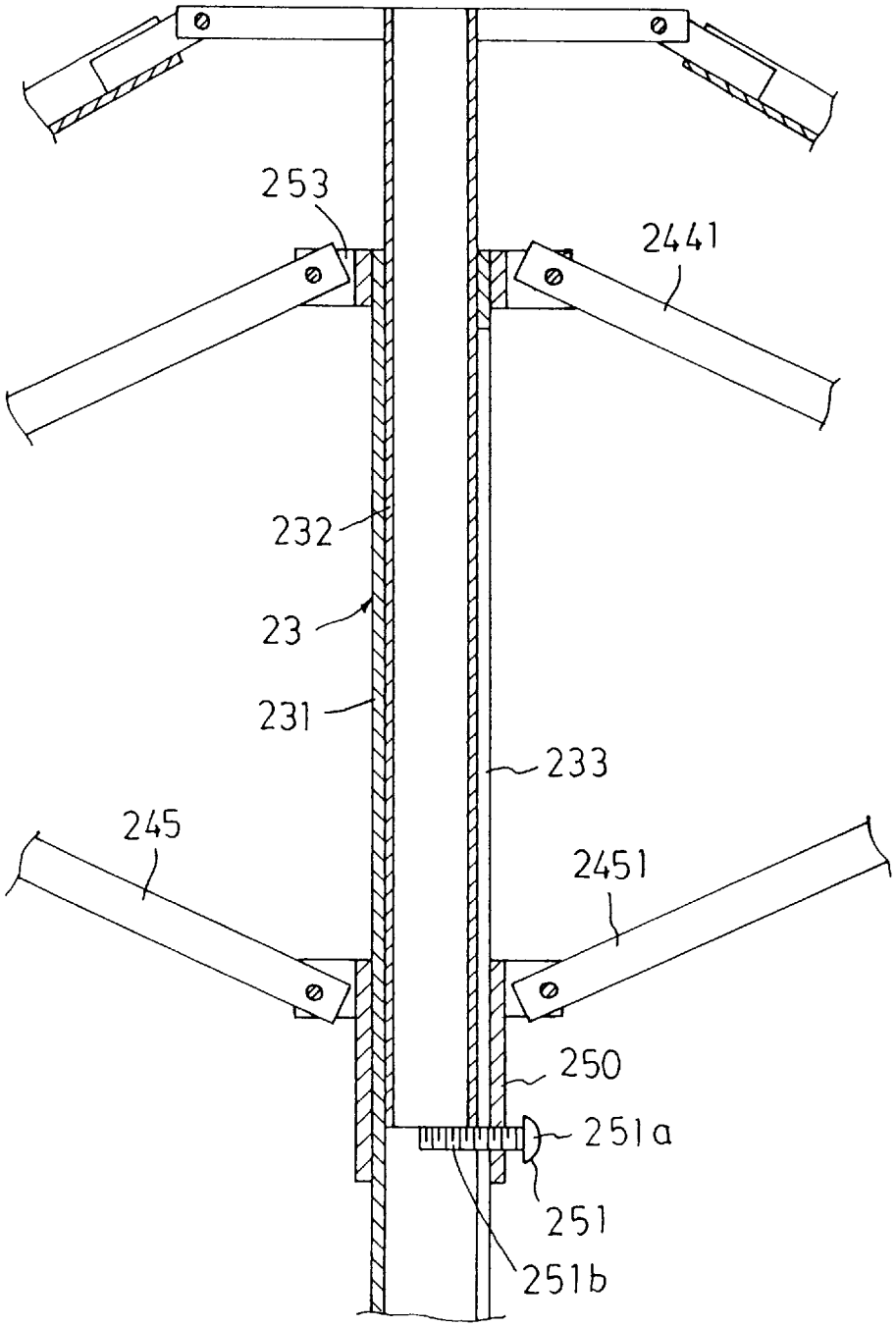
FIG. 3 is a sectional view showing a portion of a shaft of the preferred embodiment.

With reference to FIG. 3, the shaft 23 includes an outer tube 231 and an inner tube 232 which is telescopically inserted into the outer tube 231. The outer tube 231 has a sliding slit 233 which extends longitudinally along the outer tube 231. The runner assembly 25 has a bottom runner 250 which is movably sleeved on the outer tube 231, and a stud 251 which is slidable in the sliding slit 233. The stud 251 has an outer head 251*a* which extends outwardly of the sliding slit 233, and an inner end 251*b* which extends radially into the outer tube 231 through the sliding slit 233 to abut and lift a bottom end of the inner tube 232. A top runner 253 is fixed to a top end of the outer tube 231.

Figure 4:
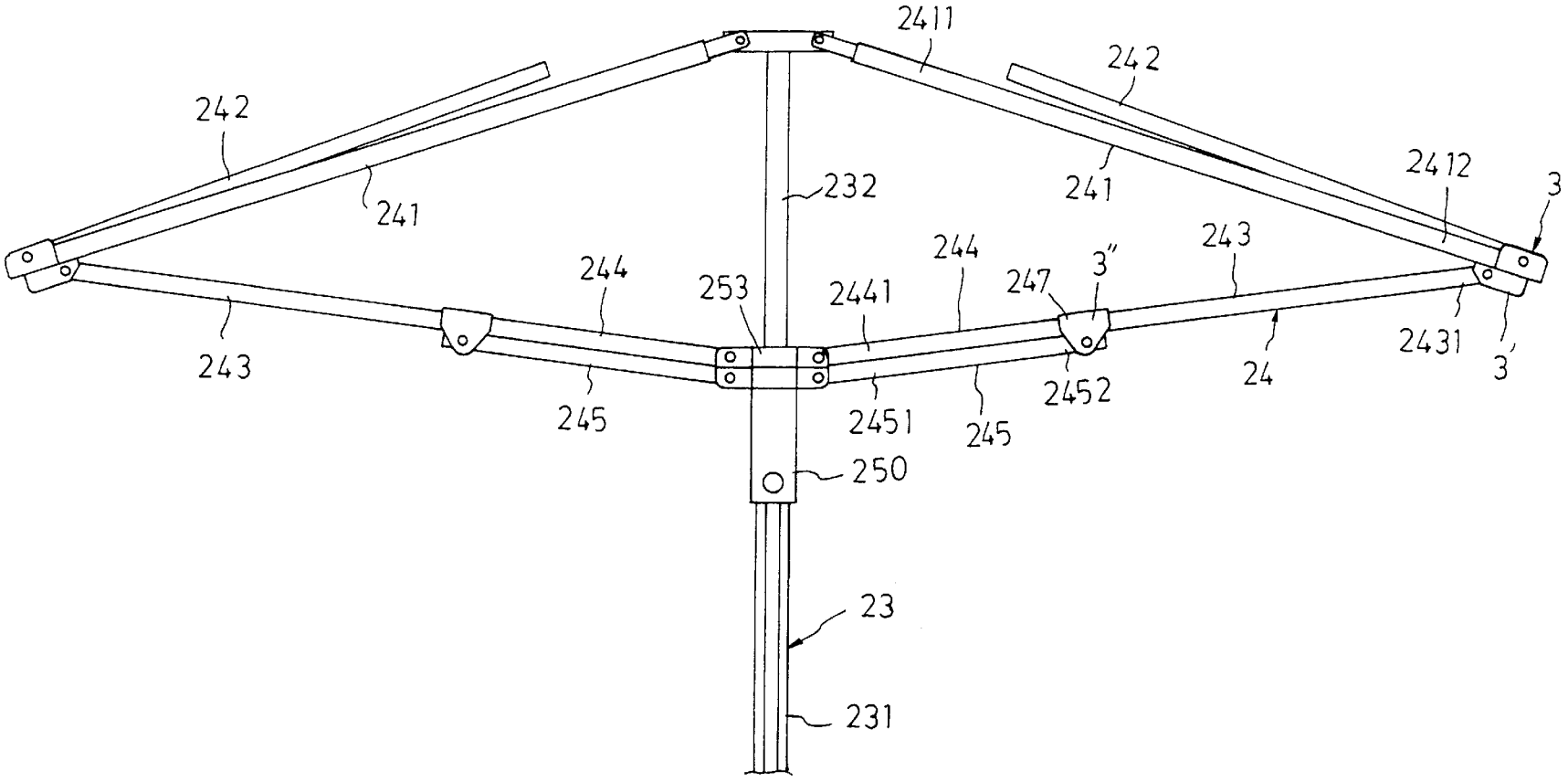
FIG. 4 is a schematic view showing a portion of a frame of the preferred embodiment.
Figure 5:
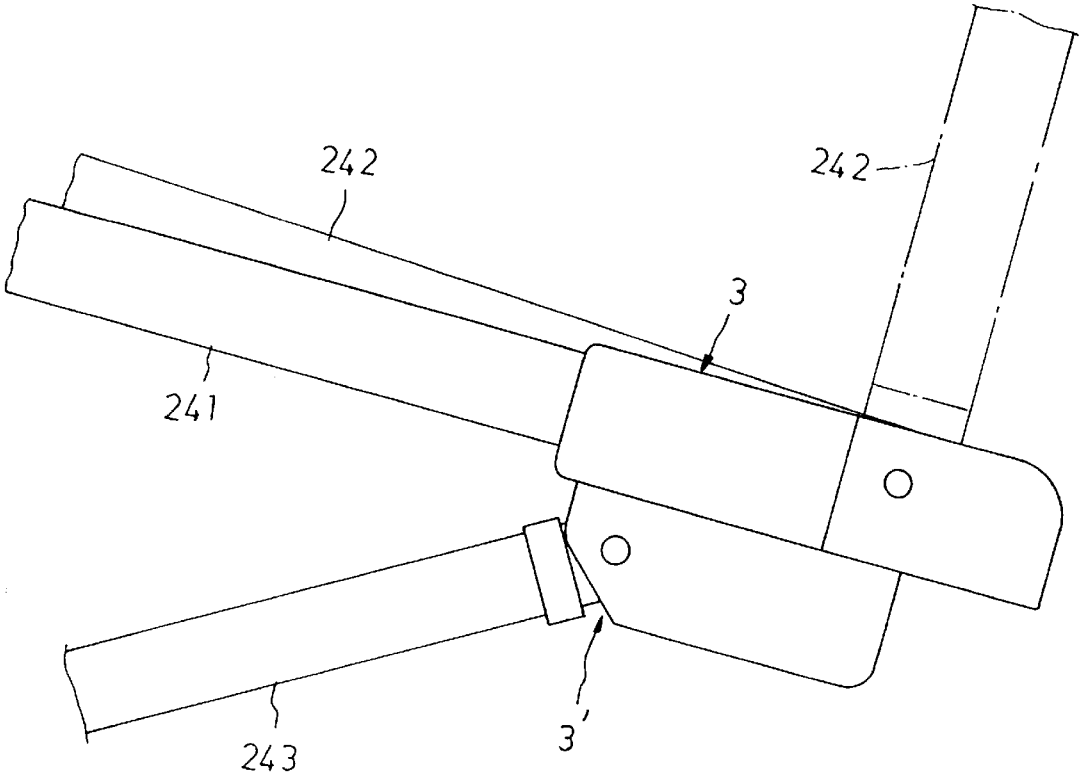
FIG. 5 is an enlarged view of an encircled portion (A) in FIG. 2.
Figure 6:
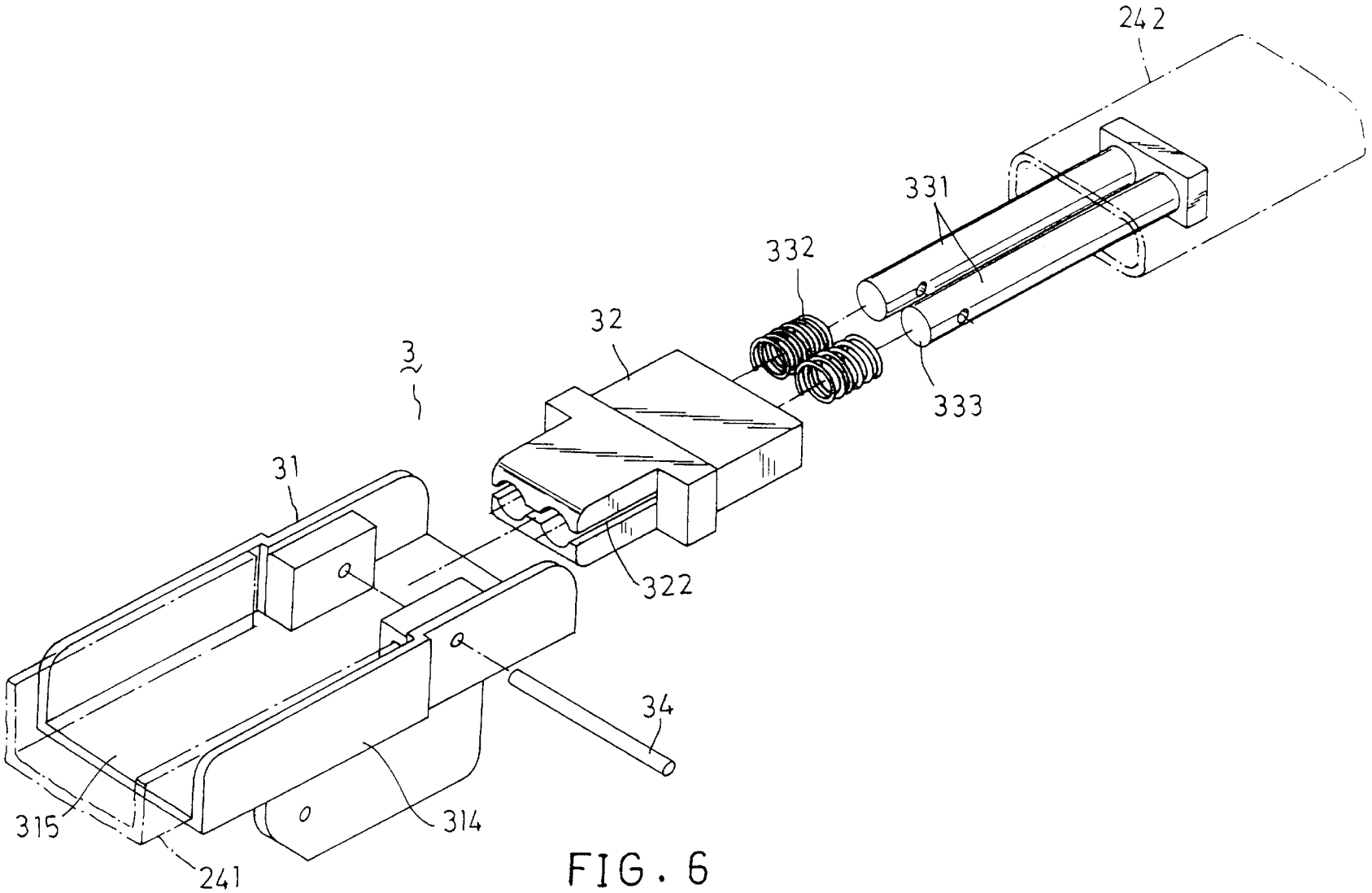
FIG. 6 is an exploded view of a pivot connector of the preferred embodiment.
Figure 7:
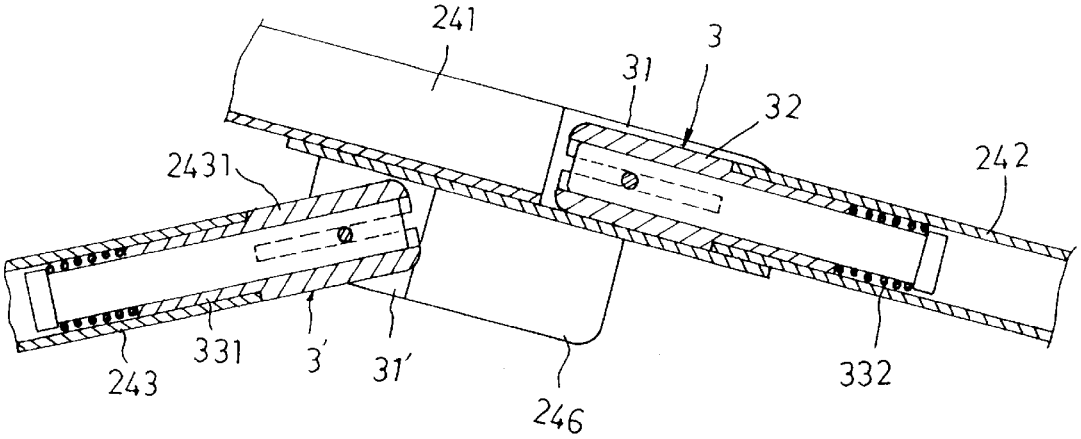
FIG. 7 is an enlarged sectional view of the encircled portion (A) in FIG. 2.
Figure 8:
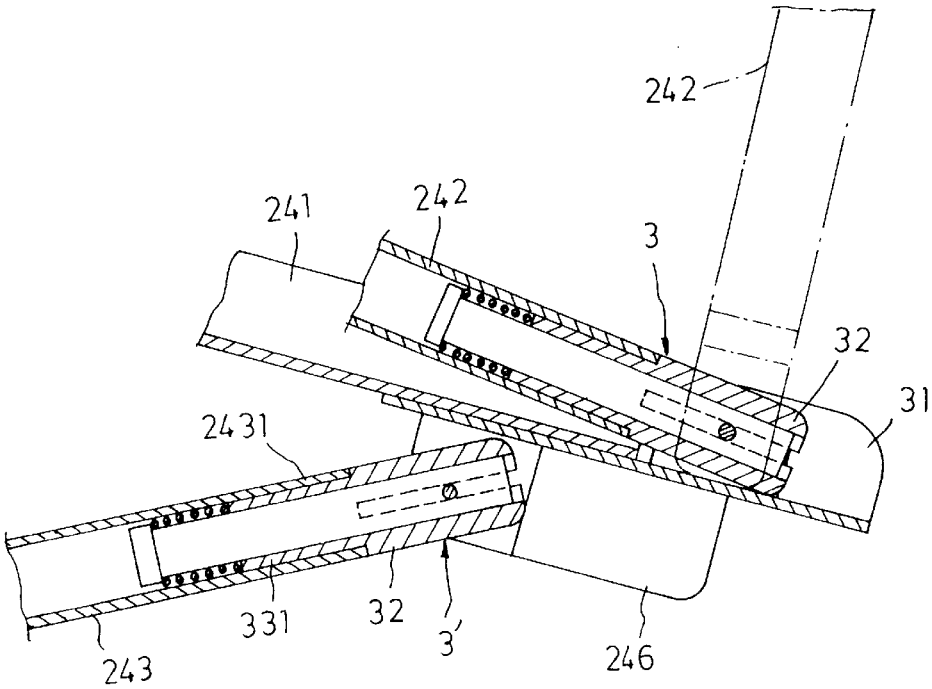
FIG. 8 is a sectional view similar to FIG. 7 but in another operating state.

Referring to FIGS. 4 and 5 in combination with FIG. 3, the main rib assembly includes a plurality of main ribs 241 and extension ribs 242. The main ribs 241 have proximal ends 2411 pivoted on a top end of the inner tube 232, and distal ends 2412. Each extension rib 242 is pivoted to the corresponding one of the distal ends 2412 of the main ribs 241 by a pivot connector 3. With reference to FIG. 6, the pivot connector 3 includes a channel member 31 which has two opposing plate members 314 and an intermediate plate member 315 interconnecting the opposing plate members 314. A pivot pin 34 extends across the opposing plate members 314. A pair of shaft members 331 extend into the channel member 31 for mounting on the pivot pin 34 so as to be turnable between a collapsed position and a stretched position relative to the channel member 31. A sleeve 32 is movably provided on the shaft members 331 and is received in the channel member 31. The sleeve 32 is formed with a slit 322 for passage of the pivot pin 34. Springs 332 are provided around the shaft members 331 to urge the sleeve 32 to project from proximal ends 333 of the shaft members 331 in the axial directions of the shaft members 331. The shaft members 331 and the channel member 31 are mounted to the extension rib 242 and the main rib 241, respectively. Referring to FIGS. 7 and 8, the sleeves 32, which are biased by the springs 332, can impede the extension ribs 242 from turning relative to the main ribs 241. When the extension ribs 242 are forced to turn about the pivot pin 34, as shown in FIG. 8, the proximal ends 333 of the shaft members 331 (as best shown in FIG. 6) move toward the intermediate plate member 315. Since the sleeve 32 is urged to contact resiliently the intermediate plate member 315, the turning actions of the shaft members 331, as well as the extension ribs 242, are impeded. The pivot connector 3 is advantageous for preventing the undesirable collapsing of the extension ribs 242 by gusts of wind.

Referring again to FIG. 4, the stretcher assembly includes a plurality of short ribs 245 and long ribs 24. Each short rib 245 has a first end 2451 which is connected to the bottom runner 250, and a second end 2452 opposite to the first end 2451. Each long rib 24 has an inner part 244, an outer part 243 and an intermediate part 247. The inner part 244 has a third end 2441 which is pivoted to the top runner 253. The outer part 243 has a fourth end 2431 which is pivoted to the distal end 2412 of the respective main rib 241 by another pivot connector 3'. As shown in FIGS. 7 and 8, the channel member 31' of the pivot connector 3' is mounted to a bottom tab 246 of the channel member 31 of the pivot connector 3 described beforehand. The construction of the pivot connector 3' differs from that of the pivot connector 3 merely in that the channel member 31' is shaped differently from the channel member 31 while having opposing plate members like the channel member 31. The pivot connector 3' has shaft members 331 which are connected to the fourth end 2431 of the outer part 243 of the long rib 24.

Figure 9:
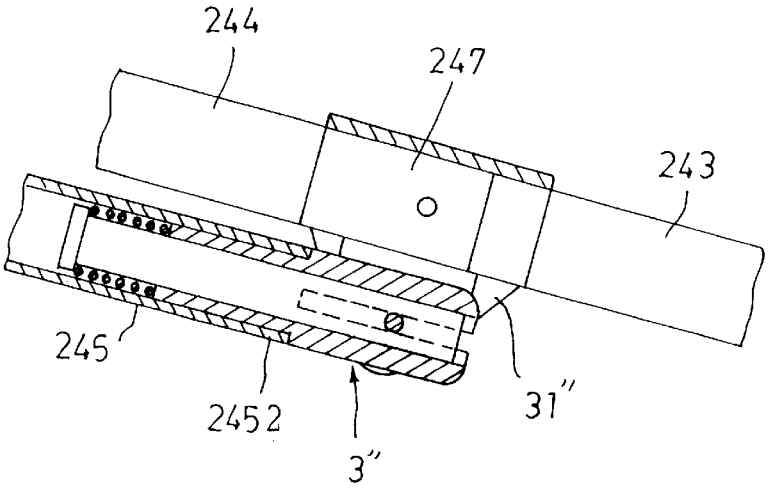
FIG. 9 is an enlarged sectional view of an encircled portion (B) in FIG. 2.
Figure 10:
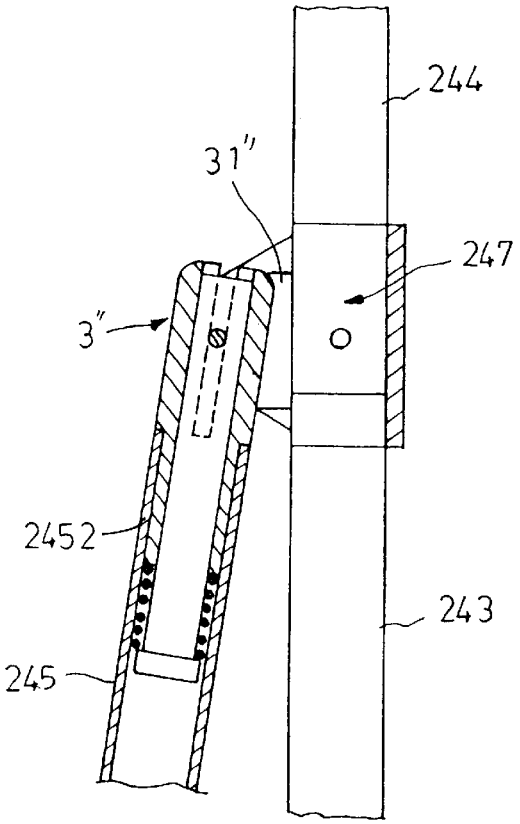
FIG. 10 is a sectional view similar to FIG. 9 but in another operating state.

With reference to FIGS. 9 and 10, the intermediate part 247 is pivotally connected to the second end 2452 of the short rib 245 by a pivot connector 3" in the same manner as described hereinbefore. The construction of the pivot connector 3" is substantially the same as that of the pivot connector 3, except for a slight difference in the shape of the channel member 31".

Figure 11:
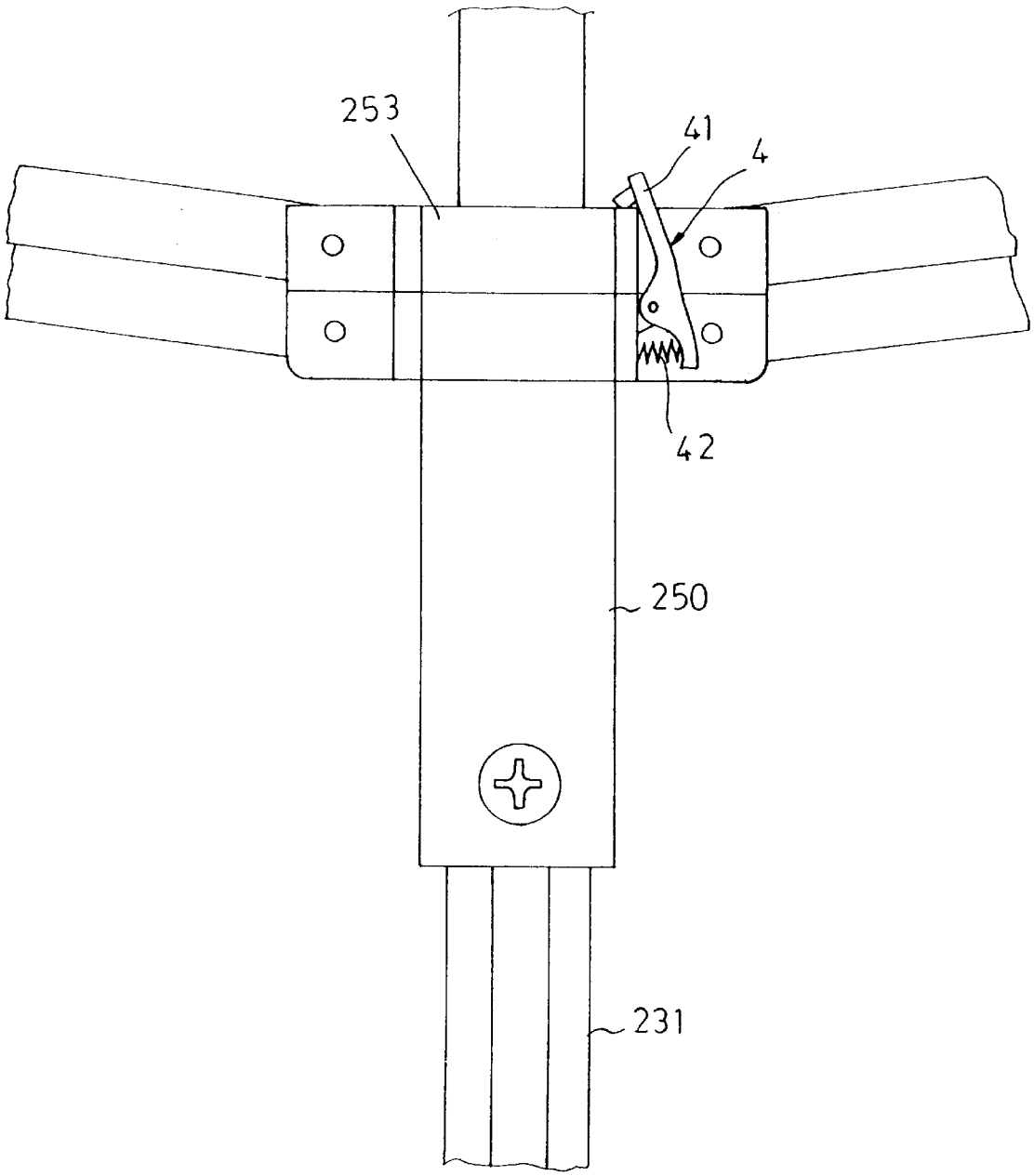
FIG. 11 is a schematic view of a dog member used in the preferred embodiment.

Referring to FIG. 11, a dog member 4 is fulcrumed on the bottom runner 250, and has an end hook 41 for hooking onto the top runner 253 when the bottom runner 250 moves to contact with the top runner 253, thereby locking the bottom runner 250 against the top runner 253 and stretching the main ribs 241. A spring 42 urges the dog member 4 to enable hooking of the end hook 41 onto the top runner 253.

Figure 12:
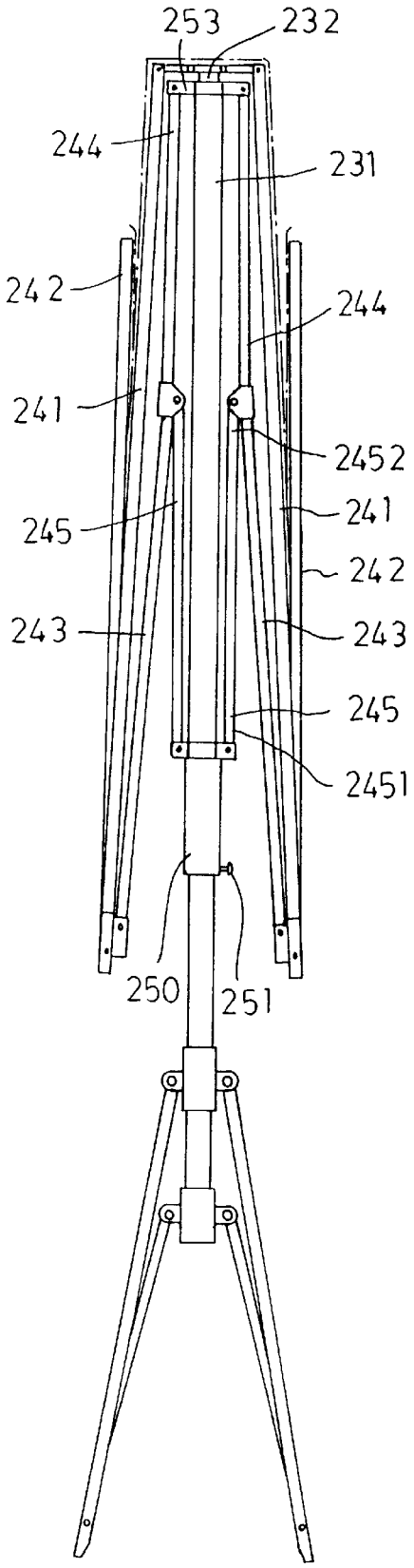
FIG. 12 is a schematic view of the preferred embodiment in a collapsed state.

FIG. 12 shows the collapsible sunshade of the preferred embodiment in a collapsed state. When it is desired to stretch the sunshade, the user holds the bottom runner 250 and forces the same upward so as to lift the bottom end of the inner tube 232 by means of the stub 251 relative the outer tube 231. At the same time, the first ends 2451 of the short ribs 245 are moved upward, thereby turning the second ends 2452 of the short ribs 245 about the bottom runner 250 and actuating the long ribs 24 to turn about the top runner 253. The long ribs 24 actuate the main ribs 241 to extend outward. As shown in FIGS. 4 and 11, after the bottom runner 250 abuts against the top runner 253, the dog member 4 is operated to fasten the bottom runner 250 to the top runner 253.

When the sunshade is to be collapsed, the end hook 41 of the dog member 4 is pressed to unlock the runners 250, 253. The inner tube 232 and the bottom runner 250 move downward, due to the weights of the inner tube 232 and the components attached to the inner tube 232, thereby moving the first ends 2451 of the short ribs 245 downward and the second ends 2452 upward. The long ribs 24 are therefore actuated by the short ribs 245 and turn towards the outer tube 231. The frame 21 of the sunshade is collapsed as shown in FIG. 12. The extension ribs 242 are operated manually to collapse relative to the main ribs 241. As illustrated, the inner tube 232 enters completely the outer tube 231, and the main rib assembly and the stretcher assembly are collapsed around the outer tube 231, thereby facilitating storage and transport.

As mentioned above, the main rib assembly and the stretcher assembly can be stretched simultaneously with the upward extension of the inner tube 232 from the outer tube 231. In addition, the use of the extension ribs 242, which are foldable relative to the main ribs 241, increases the shading area of the sunshade. The collapsible main rib assembly and the telescopic construction of the shaft 23 facilitate storage and transport of the sunshade of this invention.

Figure 13:
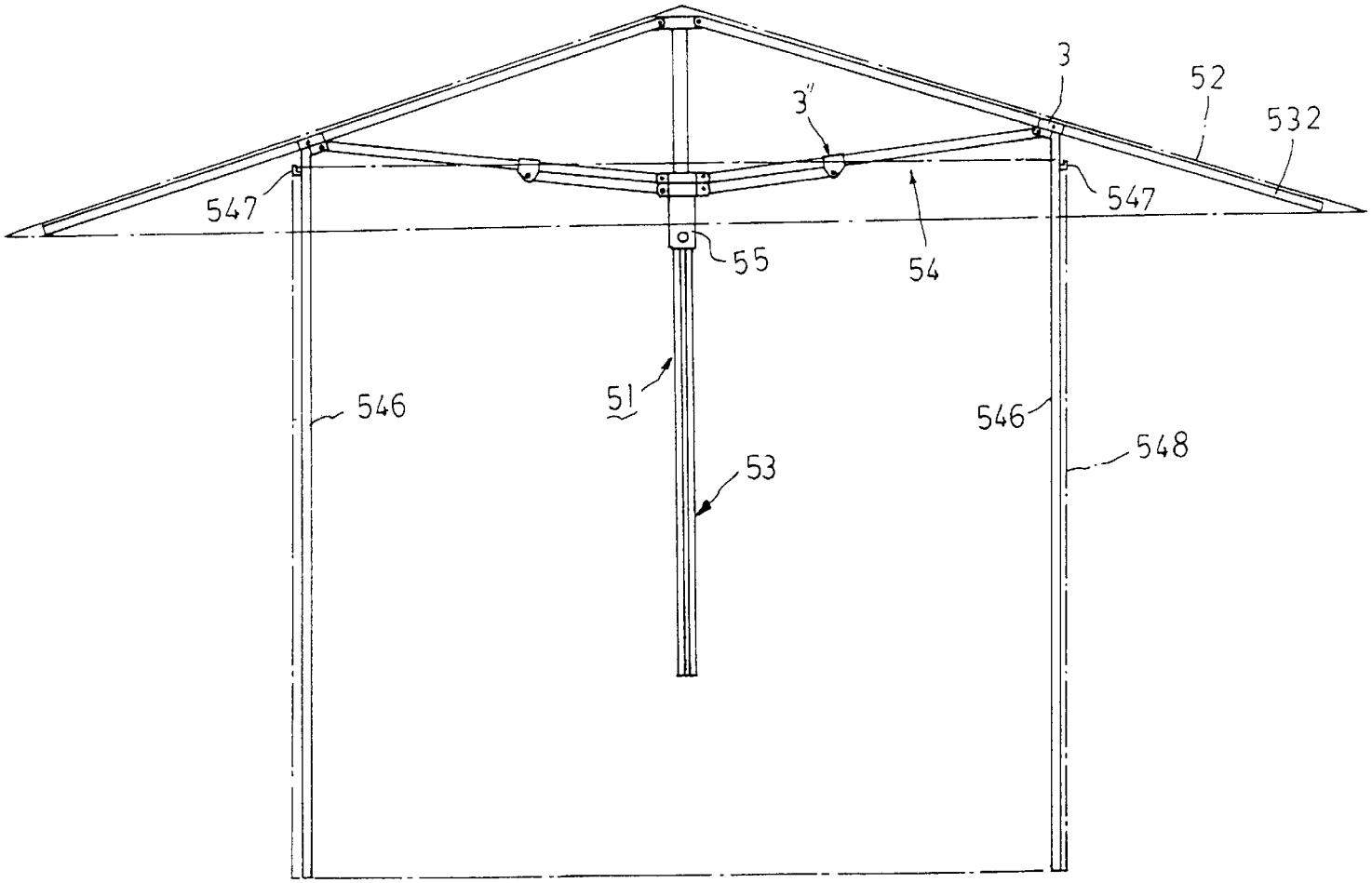
FIG. 13 is a schematic view of another preferred embodiment of the sunshade according to this invention.

Referring to FIG. 13, another preferred embodiment of the sunshade according to this invention is shown. The collapsible sunshade of this embodiment has a construction similar to that of the previous embodiment, and has a frame 51 and a top cover 52 mounted on the frame 51. The frame 51 includes a telescopic shaft 53, a plurality of stretchable and collapsible main rib and stretcher assemblies 54, and runner assembly 55 sleeved on the shaft 53. The difference of this embodiment resides in that a plurality of vertical shafts 546 are pivotally connected to the pivot connectors 3, respectively. Each vertical shaft 546 is provided with a hook 547 adjacent to the extension rib 532. A cloth covering 548 is hooked on the hooks 547. This embodiment can be used as a camping tent.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A collapsible sunshade including a frame and a top cover which is mounted on said frame, said frame comprising:

a shaft including an outer tube and an inner tube which is telescopically inserted into said outer tube;

runner means sleeved on said outer tube;

a main rib assembly pivoted to a top end of said inner tube for mounting said top cover; and a stretcher assembly pivoted to said main rib assembly and connected to said runner means;

said runner means having means for cooperating with a bottom end of said inner tube so as to move said inner tube upward and outward from said outer tube when said runner means is moved upward to stretch said main rib assembly.

2. The collapsible sunshade as claimed in claim 1, wherein said outer tube has a sliding slit which extends longitudinally along said outer tube, said cooperating means of said runner means having a stud which is slidable in said sliding slit, said stud having an outer head that extends outwardly of said sliding slit, and an inner end that extends radially into said outer tube through said sliding slit to abut and lift said bottom end of said inner tube.

3. The collapsible sunshade as claimed in claim 1, wherein said runner means includes a bottom runner movably sleeved around said outer tube and cooperatively associated with said bottom end of said inner tube, and a top runner fixed to a top end of said outer tube.

4. The collapsible sunshade as claimed in claim 3, wherein said stretcher assembly includes:

a plurality of short ribs, each of which has a first end connected to said bottom runner, and a second end opposite to said first end; and a plurality of long ribs, each of which has a third end pivoted to said top runner, a fourth end pivoted to said main rib assembly, and an intermediate part pivotally connected to said second end of a corresponding one of said short ribs.

5. The collapsible sunshade as claimed in claim 4, further comprising a dog member which is fulcrumed on said bottom runner and which has an end hook for hooking onto said top runner when said bottom runner moves to said top runner for stretching said main rib assembly.

6. The collapsible sunshade as claimed in claim 4, wherein said main rib assembly is foldable, and has a plurality of main ribs with proximal ends pivoted on said top end of said inner tube, and distal ends, and a plurality of extension ribs, each of which is pivoted to a corresponding one of said distal ends of said main ribs, said fourth end of each of said long ribs being pivoted to a corresponding one of said distal ends of said main ribs.

7. The collapsible sunshade as claimed in claim 6, wherein said stretcher assembly and said main rib assembly further includes pivot connectors, some of said pivot connectors interconnecting said main ribs and said extension ribs, some of said pivot connectors interconnecting said long ribs and said main ribs, remaining ones of said pivot connectors interconnecting said short ribs and said long ribs;

each of said pivot connectors including a channel member, a pivot pin extending across said channel member, a shaft member extending into said channel member and having a proximal end mounted on said pivot pin so as to permit turning of said shaft member between a collapsed position and a stretched position relative to said channel member, a sleeve movably provided on said shaft member and received in said channel member, and a spring provided around said shaft member to urge said sleeve to project from said proximal end of said shaft member in an axial direction of said shaft member, thereby impeding said shaft member from turning relative to said channel member.

8. The collapsible sunshade as claimed in claim 7, wherein said channel member has two opposing plate members to hold two ends of said pivot pin, and an intermediate plate member interconnecting said opposing plate members, said proximal end of said shaft member moving toward said intermediate plate member when turned about said pivot pin, said sleeve being urged to contact resiliently said intermediate plate member to prevent said proximal end of said shaft member from moving easily past said intermediate plate member.

9. A collapsible sunshade including a frame and a top cover which is mounted on said frame, said frame comprising:

a shaft including an outer tube and an inner tube which is telescopically inserted into said outer tube;

runner means sleeved on said outer tube;

a main rib assembly provided on a top end of said inner tube for mounting said top cover; and a stretcher assembly pivoted to said main rib assembly and connected to said runner;

at least one of said stretcher assembly and said main rib assembly further including a pivot connector which includes a channel member, a pivot pin extending across said channel member, a shaft member extending into said channel member and having a proximal end mounted on said pivot pin so as to permit turning of said shaft member between a collapsed position and a stretched position relative to said channel member, a sleeve movably provided on said shaft member and received in said channel member, and a spring provided around said shaft member to urge said sleeve to project from said proximal end of said shaft member in an axial direction of said shaft member, thereby impeding said shaft member from turning relative to said channel member.

10. The collapsible sunshade as claimed in claim 9, wherein said channel member has two opposing plate members to hold two ends of said pivot pin, and an intermediate plate member interconnecting said opposing plate members, said proximal end of said shaft member moving towards said intermediate plate member when turned about said pivot pin, said sleeve being urged to contact resiliently said intermediate plate member to prevent said proximal end of said shaft member from moving easily past said intermediate plate member.

* * * * *